US009994420B2

(12) United States Patent
Bewley, Jr.

(10) Patent No.: US 9,994,420 B2
(45) Date of Patent: Jun. 12, 2018

(54) TENSION DEPENDENT BRAKE ACTUATION FOR CABLE MANAGEMENT AND DEPLOYMENT

(71) Applicant: BAE Systems Information And Electronic Systems Integration Inc., Nashua, NH (US)

(72) Inventor: Peter D. Bewley, Jr., Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 188 days.

(21) Appl. No.: 14/932,398

(22) Filed: Nov. 4, 2015

(65) Prior Publication Data

US 2016/0122153 A1 May 5, 2016

Related U.S. Application Data

(60) Provisional application No. 62/074,987, filed on Nov. 4, 2014.

(51) Int. Cl.

| | |
|---|---|
| ***B65H 59/04*** | (2006.01) |
| ***B65H 59/38*** | (2006.01) |
| ***B65H 59/36*** | (2006.01) |

(52) U.S. Cl.
CPC ..... *B65H 59/382* (2013.01); *B65H 59/04* (2013.01); *B65H 59/36* (2013.01); *B65H 59/387* (2013.01)

(58) Field of Classification Search
CPC ..... B65H 59/04; B65H 59/36; B65H 59/382; B65H 59/387
See application file for complete search history.

(56) References Cited

U.S. PATENT DOCUMENTS

| | | | | |
|---|---|---|---|---|
| 3,589,652 A * | 6/1971 | Thompson, Jr. | B64F 1/02 | 242/421.4 |
| 4,004,750 A * | 1/1977 | Seagrave, Jr. | B65H 49/20 | 242/421 |
| 4,830,300 A * | 5/1989 | Taylor | B65H 54/58 | 242/390 |
| 5,176,334 A * | 1/1993 | Dreschau | B65H 23/16 | 226/44 |
| 5,533,711 A * | 7/1996 | Pickrell | B65H 51/30 | 242/396.9 |
| 6,988,854 B2 * | 1/2006 | Porter | G02B 6/506 | 242/387 |

* cited by examiner

*Primary Examiner* — Sang K Kim
(74) *Attorney, Agent, or Firm* — Sand & Sebolt, LPA; Scott J. Asmus

(57) ABSTRACT

A cable management system and method of use are provided in which brake actuation which controls a cable payout rate may be dependent on cable tension. A control system may be provided for adjusting cable tension and braking force.

15 Claims, 6 Drawing Sheets

TENSION DEPENDENT BRAKE ACTUATION FOR CABLE MANAGEMENT AND DEPLOYMENT

CROSS-REFERENCE TO RELATED APPLICATION

This application claims priority from U.S. Provisional Patent Application Ser. No. 62/074,987, filed Nov. 4, 2014, the disclosure of which is incorporated herein by reference.

BACKGROUND

Technical Field

The technical field relates to cable management and deployment and associated brake actuation.

Background Information

Various types of brake actuation have been developed for cable management systems. For instance, some brake actuation types are embodied in the Integrated Defensive Electronic Countermeasures (IDECM) system and other similar "smart brakes" based decoy deployment systems. The cable deployment control brake uses an electromagnetic solenoid, multiple high friction rotors and stators and a spring for power off actuation. Large numbers of friction generating surfaces (e.g., 8 stators & 7 rotors) may be required to provide braking torque for the loads generated over operationally significant deployment flight envelopes. The large number of rotors and stators are required to generate sufficient torque due to the force generation limitation of solenoids given the volume available for the IDECM system. The force generated by each solenoid is a function of the physical size (number of windings) of the solenoid and the power available (electrical current) for actuation. The amount of force generated is also dependent on a number of tightly controlled physical design elements. The assembly tolerances must be held very tightly (+/−0.001 inch), and manually adjusted at the time of manufacture to ensure proper operation. The solenoid actuated brake is designed to hold the cable at any given length, at maximum torque capacity, once stopped without power applied. However, it cannot hold a load at an intermediate torque rating or provide a no torque condition without power being applied. Thus, there is room for improvement beyond current cable management systems.

SUMMARY

In one aspect, an apparatus may comprise a spool; a cable wound around the spool and including a cable segment which extends outwardly from the spool; and a brake which is operatively connected to the spool and controls a spool rate of rotation of the spool based on an amount of tension on the cable segment.

In another aspect, an apparatus may comprise a spool; a brake rotor operatively connected to the spool so that a spool rate of rotation of the spool is dependent on a brake rotor rate of rotation of the brake rotor; a cable wound around the spool and including a cable segment which extends outwardly from the spool; an arm; a sheave which engages the cable segment and is rotatably mounted on the arm about a sheave axis; a lever pivotable about a lever axis; and a brake pad mounted on the lever and engageable with the brake rotor; wherein the arm is operatively connected to the lever so that movement of the arm and sheave perpendicular to the sheave axis causes pivotal movement of the lever about the pivot axis, thereby altering a braking force applied by the brake pad to the brake rotor.

In another aspect, a method may comprise the steps of providing a cable which is wound on a spool and includes a cable segment which extends outwardly from the spool; calculating with a feedback and control system an amount of tension on the cable segment based on engagement of a rotatable sheave with the cable segment; and controlling with a brake a rate of rotation of the spool based on the amount of tension.

BRIEF DESCRIPTION OF THE SEVERAL VIEWS OF THE DRAWINGS

One or more sample embodiments are set forth in the following description, shown in the drawings and particularly and distinctly pointed out and set forth in the appended claims.

Similar numbers refer to similar parts throughout the drawings.

DESCRIPTION

Figure 1A:
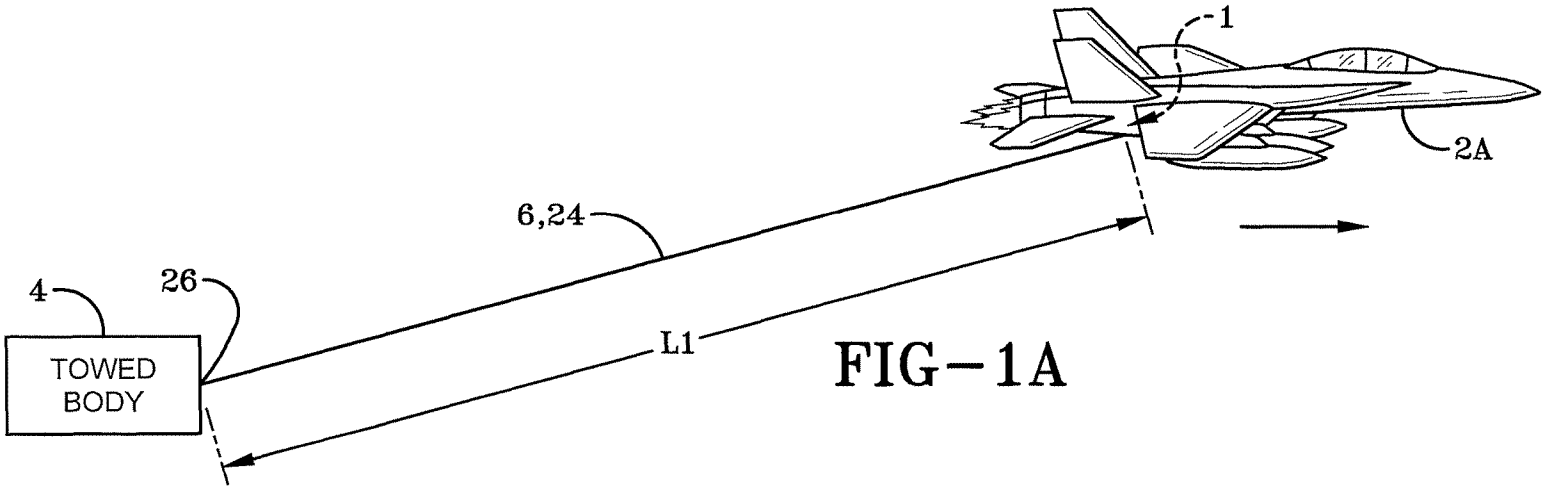
FIG. 1A is a schematic view of a cable management system in use with a towed body and a towing vehicle in the form of an aircraft.
Figure 1B:
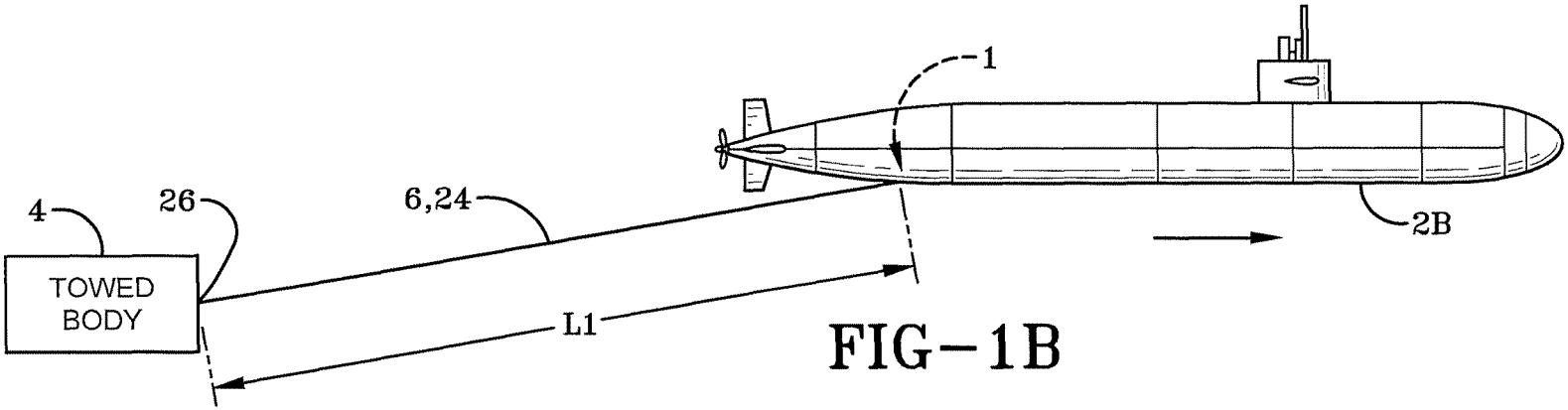
FIG. 1B is a schematic view of a cable management system in use with a towed body and a towing vehicle in the form of a submarine.
Figure 2A:
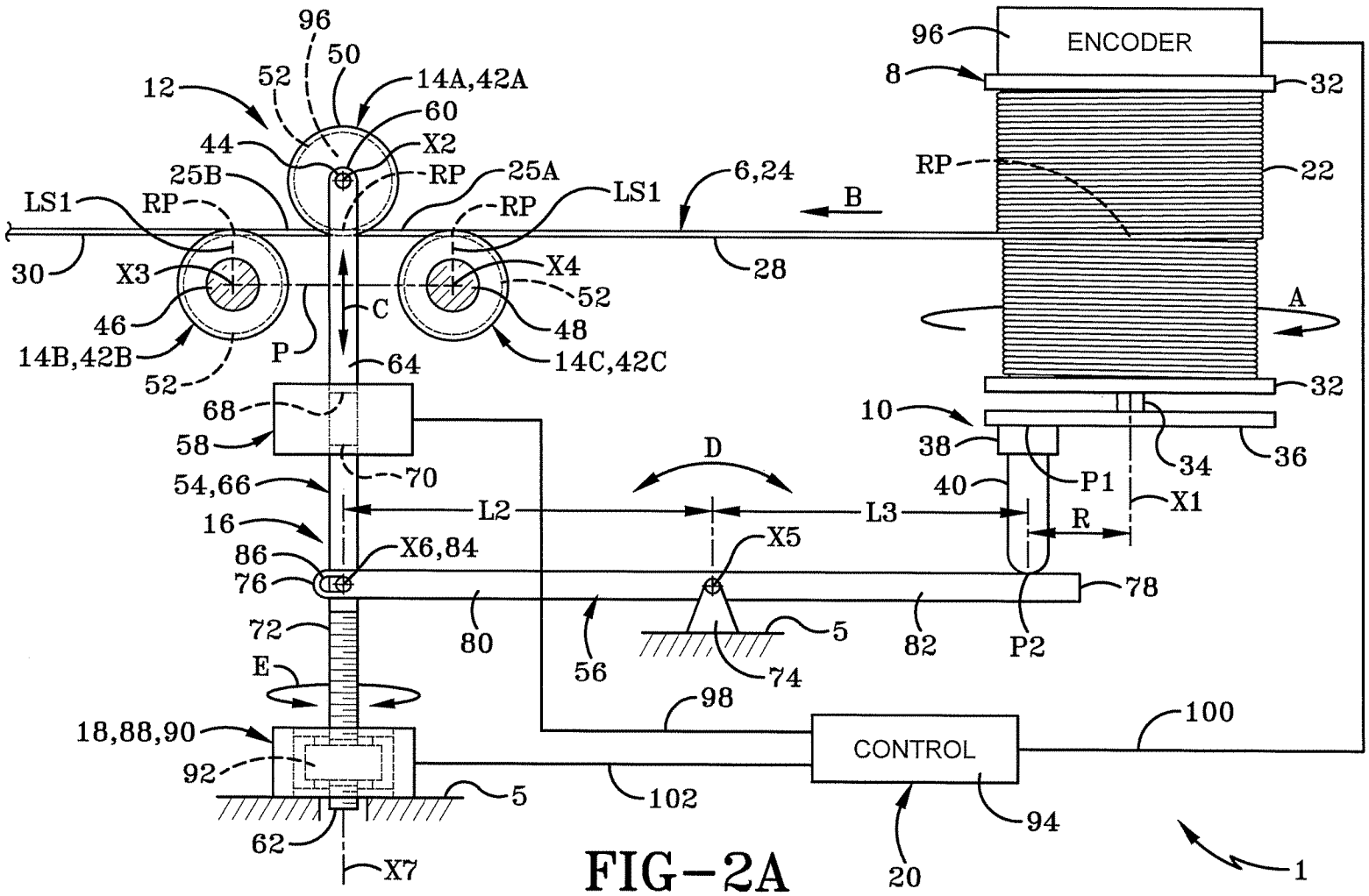
FIG. 2A is a schematic view of a cable management system at a first operational position.

A cable management system 1 is shown in FIG. 2A. System 1 may be used in various contexts including by a towing vehicle (FIGS. 1A, 1B) such as an aircraft 2A (e.g., a fixed wing aircraft or a helicopter), an underwater vehicle or submarine 2B or other powered vehicles. System 1 may be mounted on a frame 5 such as a frame of such towing vehicles for towing a towed body 4 secured to one end of a cable 6 which may be wound around and extend outwardly away from a spool 8, and which may extend rearward and downward from the towing vehicle. System 1 may further include a brake 10 and a field 12 of rotatable pulley wheels or sheaves 14A, 14B and 14C. System 1 may also include a linkage assembly 16, a tension adjustment actuator 18 and a feedback and control system 20 which may be configured to control adjustment of tension on cable 6 via actuator 18 and an amount of braking force created by brake 10.

Cable 6 may include a wound or non-deployed portion or segment 22 which is wound around spool 8 and a deployed portion or segment 24 which extends outwardly away from spool 8 and segment 22 to a terminal or deployed end 26 (FIGS. 1A, 1B) distal spool 8 and segment 22. Deployed end 26 may be secured to towed body 4. Deployed segment 24 may have a length L1 (FIGS. 1A, 1 B) from end 26 (or the connection between segment 24 and towed body 4) to a reference point RP on cable 6 which may be adjacent system 1 or the towing vehicle 2A or 2B. Some possible reference points RP are shown in FIG. 2A. One such reference point RP may be adjacent spool 8 and wound cable segment 22, such as where deployed segment extends outwardly away from segment 22 at a tangent to or intersection with the generally circular or cylindrical outer surface of the wound portion 22. Other possible reference points RP may be at or adjacent one of sheaves 14A-C, such as at or adjacent a point of contact between segment 24 and the given sheave adjacent the circular outer perimeter thereof, wherein such point RP may be where cable segment 24 contacts the given sheave outer perimeter at a tangent. Segment 24 may include a first or input portion 28 on an input side of field 12 and a second or output portion 30 on an output side of field 12. Input portion 28 may extend between wound portion 22 and field 12/sheave 14C. Input portion 28 may extend between the reference point RP adjacent wound portion 22 and the reference point RP of adjacent sheave 14C. Output portion 30 may extend outwardly from field 12/sheave 14B (and the reference point RP of sheave 14B) away from spool 8, wound portion 22, segment 28 and sheaves 14A-C to distal end 26.

Deployed segment 24 may further include sheave contact or spanning segments 25A and 25B. Segment 25A may span the gap or space between sheaves 14A and 14C and/or contact one or both sheaves 14A and 14C. For instance, in FIG. 2A, where deployed segment 24 is in an undeflected position or orientation in which segment 24 is essentially straight from the contact or reference point RP of sheave 14B to contact or reference point RP of sheave 14C (with segment 24 contacting each of sheaves 14A, 14B and 14C essentially only a single point RP), segment 25A may extend from point RP of sheave 14A to point RP of sheave 14C. Similarly, segment 25B may span the gap or space between sheaves 14A and 14B and/or contact one or both sheaves 14A and 14B. For instance, where deployed segment 24 is in the undeflected position or orientation, segment 25B may extend from point RP of sheave 14A to point RP of sheave 14B. Segments 25A and 25B may also be defined as segments which are in contact with sheaves 14C and 14B along the outer perimeters or grooves thereof, as detailed further below.

Spool 8, which may be rotatable (Arrow A) about an axis X1 with cable segment 22, may include flanges 32 which extend radially outward away from axis X1. Spool 8 may be rotatably mounted on frame 5 so that axis X1 may be stationary or fixed relative to frame 5. Flanges 32 may define therebetween a cable-receiving space in which cable segment 22 is received and wound around spool 8. Spool and segment 22 may be rotated about axis X1 in one direction (Arrow A) to unwind cable 6 from spool 8 (Arrow B) and in an opposite direction (opposite Arrow A) to wind cable 6 onto spool 8 (opposite Arrow B). Arrow B may thus represent moving more of cable 6 away from spool 8 to lengthen deployed segment 24 (increase length L1 of FIGS. 1 and 2) and decrease the amount of cable 6 making up wound segment 22, and opposite Arrow B may thus represent moving or winding more of cable 6 onto spool 8 to shorten deployed segment 24 (decrease length L1) and increase the amount of cable 6 making up wound segment 22. A shaft 34 may be secured to spool 8 and extend outward from one end of spool 8 (such as from adjacent one of flanges 32).

Brake 10 may include a brake rotor 36 and a brake pad 38 which may engage rotor 36. Rotor 36 may be secured to shaft 34 so that rotor 36 and shaft 34 may rotate together with spool 8 and wound segment 22 about axis X1. The engagement between pad 38 and rotor 36 may be a sliding or frictional engagement during rotation of rotor 36 relative to pad 38. A spring 40 may be secured to and extend outward from pad 38 in a direction away from rotor 36 and spool 8.

Pulley wheel field or sheave field 12 may include pulley wheel assemblies 42A-C which respectively include sheaves 14A-C. Pulley wheel or sheave assembly 42A may be referred to as a movable assembly, and pulley wheel or sheave assemblies 42B and 42C may be referred to as stationary or fixed assemblies. More particularly, movable pulley wheel assembly 42A may include a movable axle 44 having an axis X2 such that sheave 14A is rotatably mounted on axle 44 to rotate about axis X2. Stationary pulley wheel assembly 42B may include a stationary post or axle 46 having an axis X3 such that sheave 14B is fixedly mounted on axle 46. Stationary pulley wheel assembly 42C may include a stationary post or axle 48 having an axis X4 such that sheave 14B is fixedly mounted on axle 48. Axes X2, X3 and X4 may be parallel to one another. Axles/posts 46 and 48 may be secured to frame 5 so that posts 46 and 48 and sheaves 14B and 14C may be stationary or fixed relative to one another and frame 5 and so that axes X3 and X4 may be stationary or fixed relative to one another and frame 5. An imaginary line or plane (both represented by P) may extend from axis X3 to axis X4. Axes X3 and X4 may lie in plane P when axes X3 and X4 are parallel to one another.

Assemblies 42B and 42C may also be referred to as fixed friction posts which may or may not include a sheave 14B and 14C as described above. Each friction post 42B and 42C may be formed as a rigid structure or post which may be rigidly or fixedly mounted on frame 5 as noted above. Each of the friction posts may be formed of one or more components. Field 12 may thus also be referred as a pulley wheel and friction post field or a sheave and friction post field.

Each of sheaves 14A-C may have a circular outer perimeter 50 which may be concentric about the respective axis X2, X3 or X4. Each of sheaves 14A-C may have a circular groove 52 along outer perimeter 50 which may likewise be concentric about the respective axis X2, X3 or X4. The grooves 52 of each of sheaves 14A-C may be aligned with one another such that the three grooves 52 lie entirely along or are intersected by a common plane which may be perpendicular to axes X2, X3 and X4. Cable segment 24 may extend within each of grooves 52 and engage each of sheaves 14 along the respective outer perimeter 50/groove 52 thereof. Segment 24 may partially wrap around each of sheaves 14. An imaginary radius or line segment LS1 may extend from each of axes X3 and X4 to the corresponding reference point RP perpendicular to plane P and perpendicular to cable segment 24 in the undeflected state adjacent the respective sheave 14B and 14C, wherein the undeflected state of segment 24 is shown in FIG. 2A in solid lines and in FIGS. 2B and 2C in solid and dashed lines.

Each friction post 42B and 42C may define a circular groove 52 as noted above, or may define an arcuate or curved groove which forms an arc which is concentric about the respective axis X3 or X4. Given that cable segment 24 may engage or contact the friction post within this groove along an arc defined by an angle which is substantially less than the 360 degrees of a circular groove, the groove of each friction post 42B and 42C may extend only part way around the given friction post, and for instance be defined by an angle which may fall in a range of about 90, 100 or 110 degrees to about 160, 170 or 180 degrees. The angle defining this groove arc may be analogous to those described as angle θ further below although the groove arc may be larger as noted immediately above.

On the other hand, the friction post groove 52 may be 360 degrees or more such that cable segment 24 may wrap all the way around the friction post and engage or contact the friction post within this groove along an arc defined by an angle which may be 360 or more. For instance, the friction post groove may have a helical shape which may extend all the way around the circular outer perimeter of the friction post one or more times (e.g., 360 or 720 degrees or more).

During the unwinding of cable 6 from spool 8 or during the winding of cable 6 onto spool 8, segment 24 respectively moves away from or toward spool 8 through field 12. As segment 24 moves away from spool 8, segment 24 engages and causes sheave 14A to rotate about axis X2 in one direction (clockwise from the perspective of the Figures). As segment 24 moves toward spool 8, segment 24 engages and causes sheave 14A to rotate about axis X2 in an opposite direction (counterclockwise from the perspective of the Figures). As segment 24 moves toward or away from spool 8, segment 24 slidably or frictionally engages the fixed sheaves 14B and 14C or friction posts 42B and 42C, thereby providing frictional braking force on cable segment 24.

Movable assembly 42A including axle 44 and sheave 14A may be movable back and forth (Arrow C in FIG. 2A) relative to frame 5 and other components such as actuator 18, spool 8, brake 10 (rotor 36, pad 38), assemblies 42B and 42C including axles 46 and 48 and sheaves 14B and 14C and axes X3 and X4. The movement of sheave assembly 42A may be toward and away from line/plane P and actuator 18 and components thereof. The movement of sheave assembly 42A may be at an angle to line or plane P and at an angle to the position or line represented by segment 24 in its undeflected position. This angle may be about 90 degrees or another angle, and may, for example, be within a range of 80 or 85 degrees to 95 or 100 degrees. This angle may be controlled to a tighter tolerance, for instance +/−1, 2 or 3 degrees, such that angle may be within a range of 87, 88 or 89 degrees to 91, 92 or 93 degrees. Assembly 42A may move at an angle relative to axis X2 which is within the same ranges.

Figure 2B:
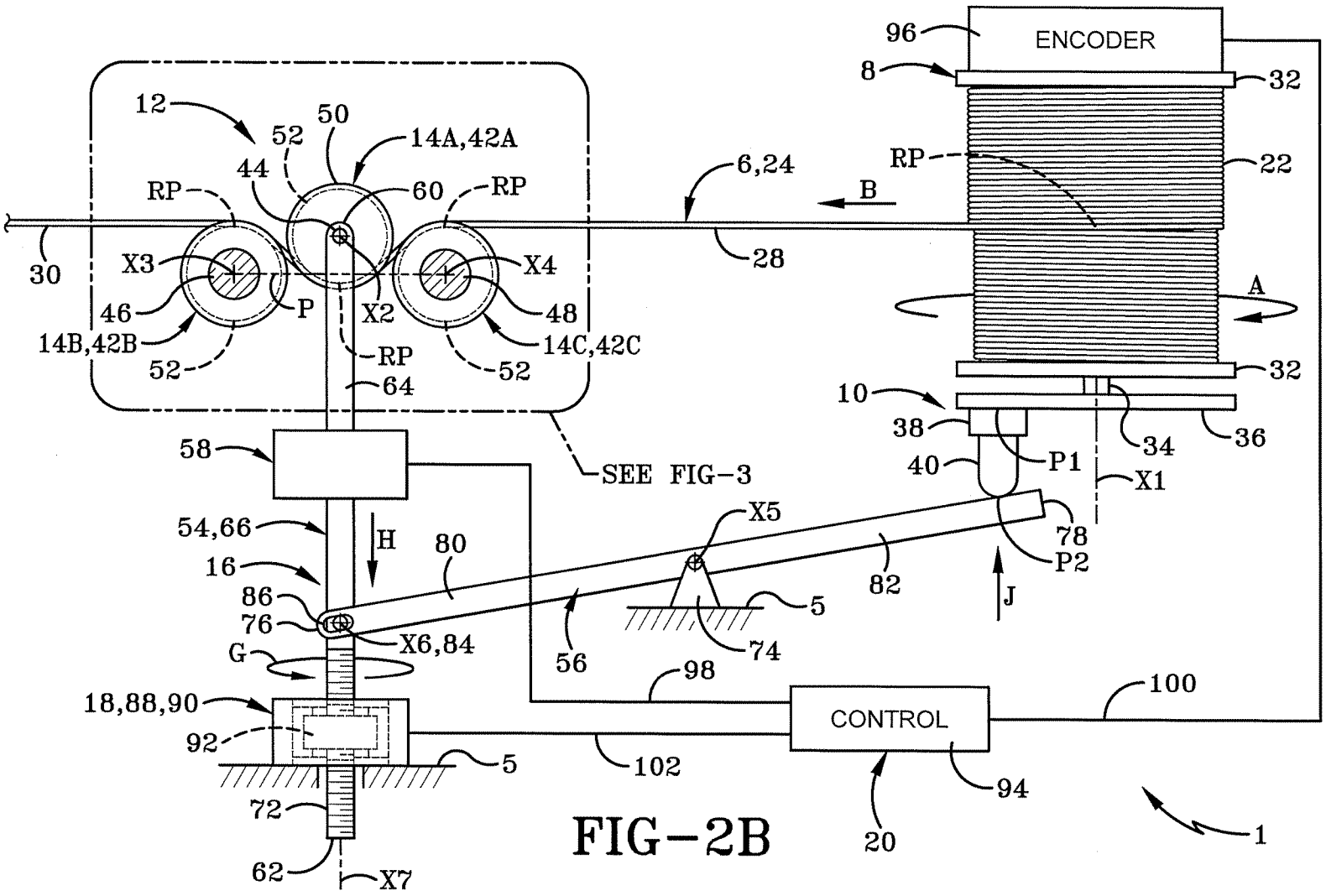
FIG. 2B is a schematic view of the cable management system of FIG. 1 at a second operational position.
Figure 2C:
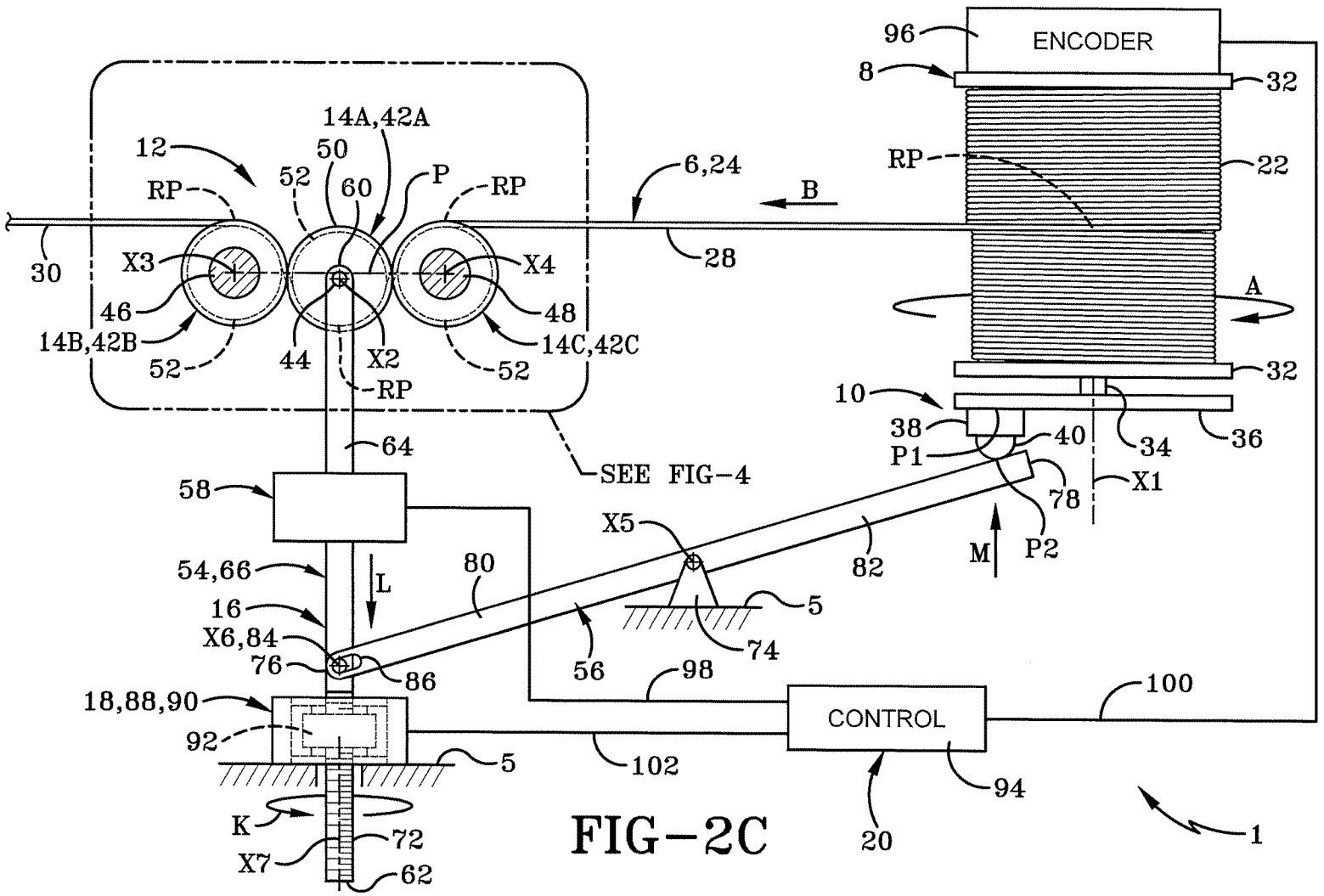
FIG. 2C is a schematic view of the cable management system of FIG. 1 at a third operational position.

In the movable sheave assembly 42 position of FIGS. 2A, sheave assembly 42A including sheave 14A, axle 44 and axis X2 may be entirely on a first side of plane P; axle 44 and axis X2 may be entirely on a first side of the undeflected position/line of segment 24 with well over a majority of sheave 14A on the first (same) side thereof; and the outer perimeter 50/groove 52 of sheave 14A may contact segment 24 essentially only at a single point RP of said perimeter 50/groove 52. In the movable sheave assembly 42 position of FIGS. 2B and 3, axle 44 and axis X2 may be entirely on the first side of plane P with a portion of sheave 14A on the first (same) side and a portion of sheave 14A on an opposite second side of plane P; axle 44 and axis X2 may be entirely on an opposite second side of the undeflected position/line of segment 24 with a portion of sheave 14A on the first side of the undeflected line and a portion of sheave 14A on the opposite second side thereof; and the outer perimeter 50/groove 52 of sheave 14A may contact segment 24 along an arc of contact which may be about twice angle θ, which is explained further below. In the movable sheave assembly 42 position of FIGS. 2C and 4, axle 44 and axis X2 may be entirely on the opposite second side of plane P with a portion of sheave 14A on the first side and a portion of sheave 14A on the opposite second side of plane P; axle 44 and axis X2 may be entirely on the opposite second side of the undeflected position/line of segment 24 with a portion of sheave 14A on the first side of the undeflected line and a portion of sheave 14A on the opposite second side thereof (or with sheave 14A entirely on the opposite second side thereof); and the outer perimeter 50/groove 52 of sheave 14A may contact segment 24 along an arc of contact which may be about twice angle θ, such that this arc of contact in FIG. 2C is substantially greater than that in FIG. 2B.

Cable input portion or segment 28 may contact sheave 14C at the reference point RP of sheave 14C, and output portion or segment 30 may contact sheave 14B at the reference point RP of sheave 14B. In the undeflected orientation or position of segment 24 (FIG. 2A), segment 24 may contact sheave 14C and 14B essentially only at these reference points (i.e., essentially only a single point of contact between segment 24 and each of sheaves 14C and 14B). When segment 24 is deflected so that movable sheave 14A has moved into a position directly in which sheave 14A extends between sheaves 14B and 14C (e.g., as shown in FIGS. 2B and 2C), there may be an arc of contact between segment 24 and each of sheaves 14B and 14C along the outer perimeters/grooves thereof, such that the given arc of contact is concentric about the respective axis X3 or X4. The arc of contact for the given sheave extends from the corresponding reference point RP of the given sheave to a corresponding end point or tangent point T at which the given segment 25A, 25B forms a tangent with the given sheave. The end or tangent point T of sheave 14B is the point of contact between segment 25B and sheave 14B, and the end or tangent point T of sheave 14C is the point of contact between segment 25A and sheave 14C. The arc of contact of cable segment 24 with the given sheave 14B and 14C may be understood as having a cable contact angle θ defined between the given radius/line segment LS1 and a radius or line segment LS2 extending from the given axis X3 or X4 to the given end or tangent point T.

Figure 3:
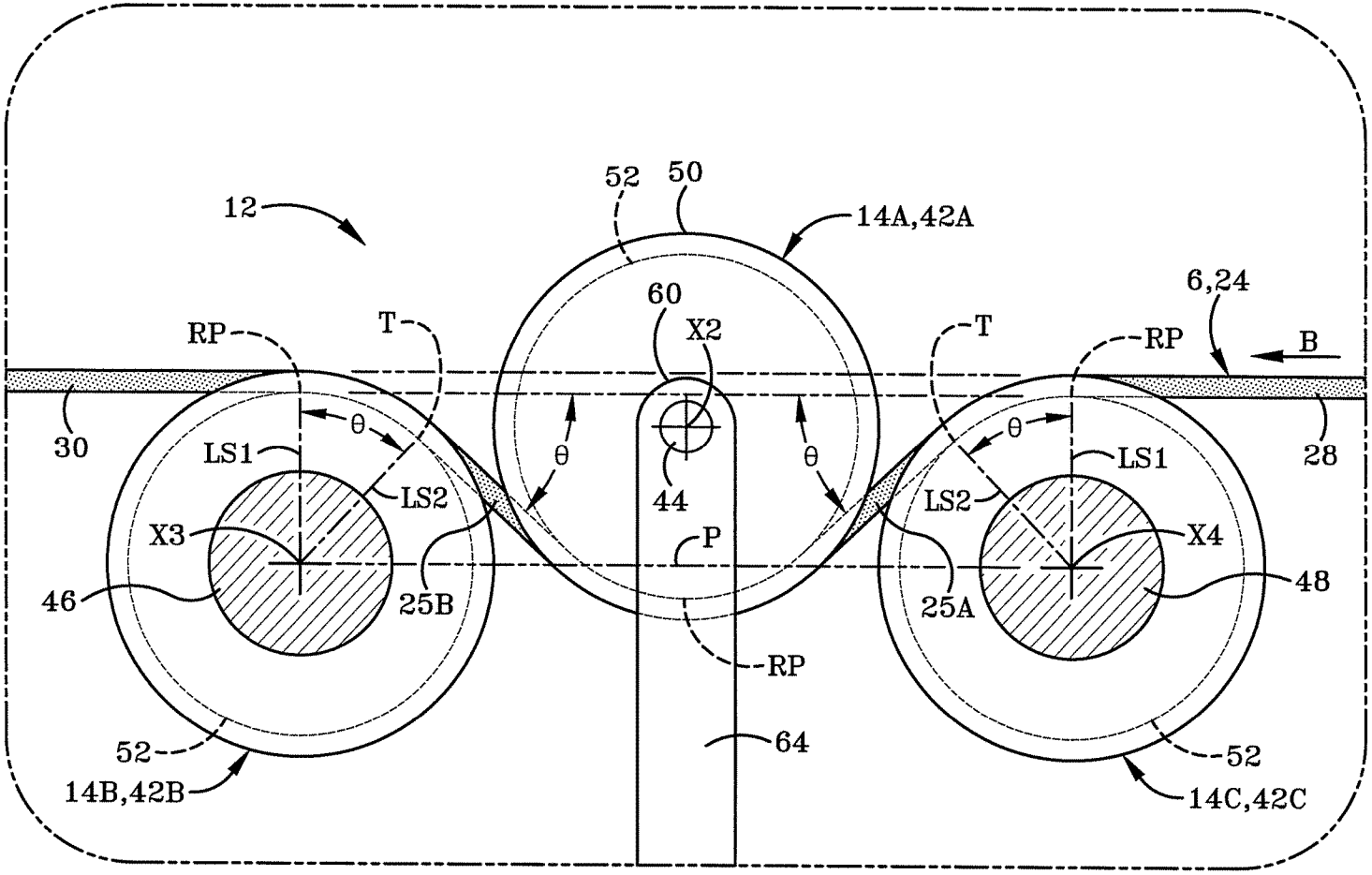
FIG. 3 is an enlarged view of the encircled portion of FIG. 2B.
Figure 4:
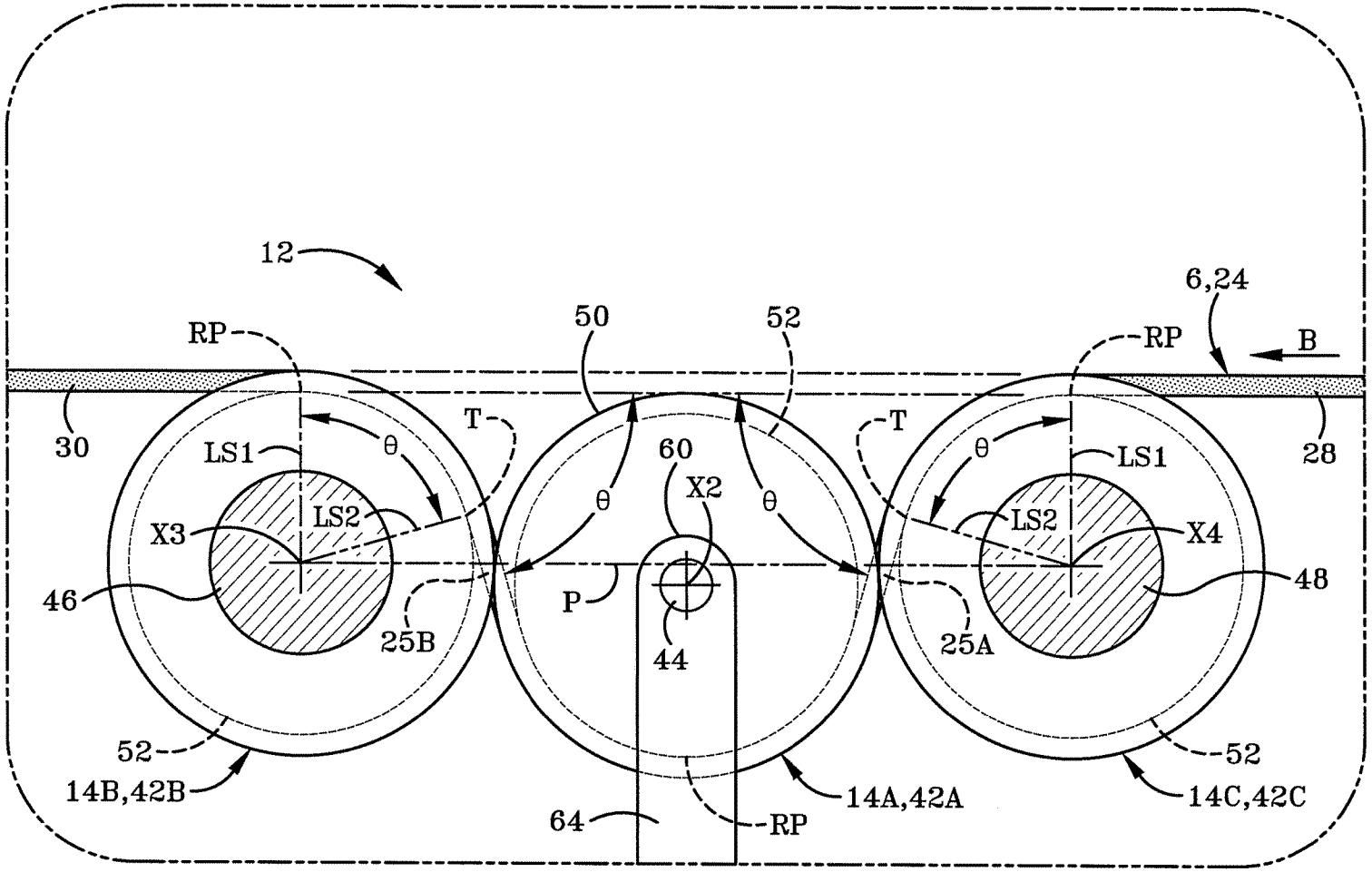
FIG. 4 is an enlarged view of the encircled portion of FIG. 2C.

FIG. 2A shows that segment 24 contacts the sheave 14C outer perimeter/groove or friction post groove at essentially only a single point, so that there is essentially no arc of contact between segment 24 and sheave 14C outer perimeter/groove, whereby contact angle θ=0, whereby angle θ is not denoted in FIG. 2A although it will be understood by one skilled in the art. FIGS. 2B and 3 show cable segment 24 contacting sheave 14C or friction post 42C within its groove 52 along an arc of contact having a contact angle θ of about 45 degrees, while FIGS. 2C and 4 show cable segment 24 with an arc of contact having a contact angle θ of about 75 or 80 degrees, which may be increased to 85 or 90 degrees when movable assembly 42A is moved further toward actuator 18. FIGS. 2A-C, 3 and 4 likewise show the same with respect to segment 24 and sheave 14B or friction post 42B, such that the contact angle θ for segment 24 and sheave 14B or friction post 42B in FIG. 2A is zero degrees, in FIGS. 2B and 3 is about 45 degrees, and in FIGS. 2C and 4 is about 75 or 80 degrees (likewise increasable to 85 or 90 degrees). It will be understood that the arc of contact between the segment 24 and the given sheave 14B, 14C will vary depending on the position of sheave assembly 42A relative to sheave assemblies 42B and 42C. As noted further above, the friction post groove 52 of friction posts 42B and 42C may extend one or more times all the way around the given friction post so that cable segment 24 may be wrapped all the way around the given friction post one or more times and engage the given friction post within the groove 52 so that the arc of contact may be defined by an angle θ which may be equal to or greater than 360 or 720 degrees.

It is noted that angle θ may also be defined between the undeflected path/line and cable segment 25A which extends from stationary sheave 14C to movable sheave 14A, or between the undeflected path/line and cable segment 25B which extends from stationary sheave 14B to movable sheave 14A. Angle θ in FIGS. 2A, 3 and 4 is thus likewise respectively about 0, 45 and 75 or 80 degrees (increasable to 85 or 90 degrees). Thus, angle θ as measured by either method may be in a range of 0-90 degrees depending on the position of sheave assembly 42A relative to sheave assemblies 42B and 42C.

Linkage assembly 16 may also be referred to as a drive train or translation assembly since movement of certain components of drive train or assembly 16 may drive movement of other components thereof (and/or other components which assembly 16 engages), or may translate force on a given component of assembly 16 to another component thereof and/or to and from components which assembly 16 engages. Linkage assembly 16 may include an arm 54, a lever 56 which may be pivotally connected to arm 54, and a force measurement transducer 58 which may be mounted on arm 54. Arm 54 may have a first end 60 and a second opposed end 62. Arm 54 may be essentially straight as viewed from the side from end 60 to end 62. Arm 54 may be formed as a single piece extending from end 60 to end 62. Arm 54 may also be formed with a first arm segment 64 and a separate second arm segment 66. Where arm 54 includes segments 64 and 66, end 60 may serve as one end of segment 64, which may have an opposite end 68 represented by a dashed line in FIG. 2A. End 62 may serve as one end of segment 66, which may have an opposite end 70 also represented by a dashed line in FIG. 2A. Axle 44 and sheave 14A may be mounted on arm 54/arm segment 64 adjacent end 60. Arm 54/segment 64 may include a yoke adjacent end 60 such that axle 44 extends between and is mounted on a pair of yoke arms of the yoke with a portion of sheave 14A disposed between the yoke arms.

Arm 54/segment 66 may include a threaded portion or segment 72 which may be adjacent end 62 and which may extend from adjacent end 62 to adjacent lever 56 and the pivotal connection between arm 54 and lever 56. Threaded portion 72 is shown as an externally threaded portion or segment although it may also be configured as an internally threaded portion or segment. Threaded segment 72 may threadedly engage a portion of actuator 18, as detailed further below.

Lever 56 may be pivotally mounted on frame 5 to pivot back and forth (Arrow D) relative to frame 5 about a pivot axis X5 which may be parallel to axes X2, X3 and X4. A fulcrum or pivot assembly 74 may be secured to frame 5 and include a pivot having pivot axis X5 so that axis X5 may be fixed relative to frame 5. Lever 56 may have first and second ends 76 and 78 between which lever 56 may be essentially straight. Pivot assembly 74 and axis X5 may be distal each end 76 and 78. Lever 56 may include a first lever segment 80 and a second lever segment 82. Segment 80 may extend from adjacent end 76 to adjacent pivot assembly 74 and axis X5, and segment 82 may extend from adjacent end 78 to adjacent pivot assembly 74 and axis X5. Lever 56 may be pivotally connected to arm 54/segment 66 at a pivot or pivot pin 84 having an axis X6 so that lever 56 is pivotable relative to arm 54, such as during the movement or translation of arm 54 shown at Arrow C. Axis X6 may be parallel to axes X2, X3, X4 and X5. Lever 56/segment 80 adjacent end 76 may define a slot 86 which receives pivot pin 84 so that during pivotal movement of lever 56 about axis X5 of pivot 74, the location of pivot 84 within slot 86 may change. For instance, pivot 84 may be adjacent one end of slot 86 in the position of lever 56 in FIG. 2A, adjacent the opposite end of slot 86 in the position of lever 56 in FIG. 2C, and intermediate the positions of FIGS. 2A and 2C when lever 56 is in the position shown in FIG. 2B.

Linkage assembly 16 may also include spring 40, which may extend between brake pad 38 and lever 56/segment 82 adjacent end 78. With reference to FIG. 2A, a radius R may extend from axis X1 to a contact point P1 of brake pad 38 with rotor 36. Axis X5 and axis X6 may define therebetween a normal distance or length L2 which extends from adjacent one end of segment 80 adjacent axis X5 to adjacent the opposite end 76 of segment 80. Spring 40 may contact lever 56/segment 82 at a contact point P2 so that axis X5 and contact point P2 define therebetween a normal distance or length L3 such that lengths L2 and L3 are measured along a common line. Length may extend from adjacent one end of segment 82 adjacent axis X5 to adjacent the opposite end 78 of segment 82. Radius R may also be the same as or nearly the same as the normal distance from axis X1 to point P2, and length L3 may be the same as or nearly the same as the normal distance from axis X5 to point P1.

Actuator 18 may include a servomotor 88 having a housing or stationary portion 90 and a rotatable threaded member 92 which may threadedly engage threaded portion 72 of arm 54. Stationary portion 90 may be secured to and fixed relative to frame 5. Threaded member 92 may rotate (Arrow E) relative to frame 5, portion 90 and arm 54/threaded portion 72 about an axis X7 of arm 54/portion 72 to move or translate arm 54, transducer 58 and movable sheave assembly 42A in the direction of Arrow C, which may be parallel to axis X7 and the length of arm 54. The movement or translation of arm 54 will cause the pivotal movement of lever 56 about axis X5. For instance, threaded member 92 may rotate about axis X7 in a first direction to cause the movement of arm 54, transducer 58 and sheave assembly 42*a* in an essentially linear direction (for instance, up with respect to FIG. 2A), which would cause segment 80 and end 76 of lever 56 to move in the same direction (up) as arm 54 and the other segment 82 and end 78 of lever 56 to move pivotally in the opposite direction as the movement of segment 80 and end 76 (down). It will be understood that rotation of threaded member 92 in the opposite direction may thus cause the linear movement of arm 54, transducer 58 and assembly 42A in the opposite linear direction (down with respect to FIG. 2A), thereby causing pivotal movement of lever 56 such that segment 80 and end 76 moves (down) along with arm 54 as lever 56 pivots about axis X5 and so that segment 82 and end 78 move in the opposite direction (up) of the movement of arm 54 and end 76 of segment 80. The pivotal movement of lever 56 about axis X5 may compress spring 40 or allow spring 40 to decompress, expand or extend. More particularly, as segment 82 and end 78 of lever 56 moves toward spring 40, brake pad 38 and rotor 36, the force applied by segment 82 on spring 40 causes compression of spring 40 so that the force is translated through spring 40 to brake pad 38 and from brake pad 38 to rotor 36, whereby the braking force applied by pad 38 to rotor 36 is increased. When lever 56 pivots in the opposite direction, so that segment 82 and end 78 of lever 56 move away from spring 40, pad 38 and rotor 36, spring 40 is allowed to decompress or expand so that the braking force applied by pad 38 to rotor 36 is decreased.

Feedback and control system 20 may include transducer 58, a control 94, an encoder 96 and electrical wires 98, 100 and 102. Transducer 58 may be a strain gauge which measures the strain in arm 54 itself. In this case, shaft or arm 54 may be a single piece and strain gauge 58 may be secured to arm 54 between one or more of (a) axis X2, axle 44 and sheave 14A and one or more of (b) axis X6, pivot 84 and lever segment 80 adjacent end 76. Transducer 58 may also be an inline force transducer which may also be secured to arm 54 in the same relative location except that arm 54 may be formed as the two segments 64 and 66 with transducer 58 secured to segment 64 adjacent end 68 and to segment 66 adjacent end 70 so that transducer 58 extends between ends 68 and 70.

Encoder 96 may be configured to measure the angular position of spool 8 as well as the spool rate of rotation about axis X1. This information may be translated by control 94 to determine the cable payout rate and how far out the cable and towed body 4 extend from system 1 and the towing vehicle 2A or 2B, in other words the value of length L1. Rotary encoder 96 may include a Hall sensor or Hall effect sensor. Thus, for instance, one or more magnets may be mounted on spool 8 to rotate therewith so that the position of the magnets may be sensed by the Hall sensor. It is noted that a similar encoder 96 may be mounted adjacent pulley wheel or sheave 14A, as shown by a dashed lead line to an encoder 96. In either case, encoder 96 may be in electrical or other communication with control 94 such as via an electrical wire or wires 100 extending between and connected to encoder 96 and control 94. Control 94 may also be in electrical or other communication with transducer 58 and actuator 18/servomotor 88, such as respectively via a wire or wires 98 and 102 which extend between and are connected to control 94 and, respectively, transducer 58 or actuator 18/servomotor 88. Control 94 may include a computer, computer program, processor and/or a logic circuit or circuits configured to process signals from encoder 96 and/or transducer 58 such as via wires 100 and 98, and based on one or more of these signals, to determine how much braking force should be applied by brake 10, whereby control 20 sends a signal to servomotor 88 such as via wire 102 to control the amount of rotation of threaded member 92, thereby controlling the degree of said braking force.

Turning momentarily to FIGS. 1A and 1B, system 1 may be used during the operation of a towing vehicle on which system 1 is mounted so that the towing vehicle may tow the towed body 4 via cable 6. Towing vehicle or aircraft 2A (FIG. 1A) may move or fly through air (a gaseous medium) while towing towed body 4 through the air/gaseous medium such that the towed body is likewise in flight (i.e., generally above ground/out of contact with the ground). Similarly, towing vehicle or submarine 2B (FIG. 1B) may move through water (a liquid medium) while partially or completely submerged and while towing towed body 4 through the water/liquid medium such that the towed body is likewise partially or completely submerged and typically above/out of contact with a seabed, lakebed, riverbed or the like which contains the water/liquid medium.

The operation of system 1 is now described in greater detail beginning with primary reference to FIGS. 2A-2C. Linkage assembly 16 extends from cable segment 24 to brake pad 38 of brake 10 so that the amount of braking force applied by brake pad 38 may be dependent on tension within cable segment 24. As noted previously, the movement of movable sheave assembly 42A and arm 54 may cause the pivotal movement of lever 56 and the compression or expansion of spring 40 so as to change the amount of force applied by pad 38 on rotor 36. For ease of description, the terms "up" and "down" may be used herein to described the movement of various components. It will be understood that the use of "up" and "down" in this context are relative to the FIGS. 2A-2C, although not necessarily related to the actual direction and operation. The term "up" or "upward" in this context may mean a first direction whereas the term "down" or "downward" may mean in another or second direction which is opposite that meant by the term "up" or "upward".

With this in mind, it may be seen that the downward movement of assembly 42, transducer 58 and arm 54 may cause the downward movement of end 76 of lever 56 and the upward movement of end 78, whereby lever segment 82 presses against spring 40, thereby compressing spring 40 and applying a greater force via pad 38 onto rotor 36. For example, as shown in FIG. 2B, threaded member 92 may be rotated in the direction shown at Arrow G such that the threaded engagement between member 92 and portion 72 causes the downward translation (Arrow H) of arm 54, transducer 58 and pulley wheel assembly 42A, causing the downward movement of end 76 via the pivotal connection at pivot 84 and the upward movement (Arrow J) of end 78 via the resulting pivotal movement of lever 56 about axis X5. FIG. 2C likewise shows additional rotation of member 92 (Arrow K) in the same direction as Arrow G in FIG. 2B to cause additional downward movement (Arrow L) of arm 54, transducer 58 and assembly 42, along with the corresponding additional downward movement of end 76 and upward movement (Arrow M) of end 78, thereby causing even further compression of spring 40 and additional braking force applied by pad 38 to rotor 36. It will be understood that rotation of threaded member 92 in the direction opposite Arrow G in FIG. 2B will cause the opposite movement such that transducer 58, assembly 42A and end 76 of segment 80 move upward opposite Arrow H while end 78 of segment 82 moves downward along with the bottom of spring 40 in the direction opposite Arrow J such that spring 40 expands or decompresses so that the force is reduced on pad 38 and the braking force of pad 38 on rotor 36 is likewise reduced. Similarly, the rotation of member 92 opposite Arrow K in FIG. 2C causes the similar opposite movement, that is opposite Arrows L and M.

The rotation of threaded member 92 as effected by servomotor 88 may be controlled by control 94 based on one or more signals received from one or both of transducer 58 and encoder 96. Control 94 may continuously monitor signals received from encoder 96 and transducer 58. Thus, control 94 may receive signals sent from encoder 96 via a transmission line or wire 100 indicative of the angular position of spool 8 and/or the rate at which spool 8 and wound portion 22 rotate about axis X1. This angular position and/or rate of rotation may be used by control 94 to calculate length L1 (FIGS. 1A and 1B) and the cable payout rate of deployed cable segment 24, that is the rate at which segment 24 is moving relative to spool 8, for instance the rate at which segment 24 is moving away from spool 8 during unwinding of cable 6 therefrom or the rate at which segment 24 is moving toward spool 8 during winding of cable 6 onto spool 8. Control 94 may also receive signals sent from transducer 58 which are indicative of tension or strain on arm 54, whereby control 94 may calculate the amount of tension on cable segment 24 at or adjacent pulley wheel 14A. Based on one or more of the signals from encoder 96 and transducer 58 and the above-noted calculations of the amount of tension, the rate of spool rotation and given length L1 of segment 24 at a given time, control 94 may then calculate the amount of braking force that needs to be applied by brake 10 at or immediately after the given time in order to properly control the payout rate of cable segment 24, whereby control 94 additionally may calculate the amount of rotation of threaded member 92 which is required in order to apply the desired amount of braking force.

Once control 94 calculates the needed braking force to be applied (which may be essentially real time or, for instance, within no more than 0.1, 0.5, 1.0, 1.5 or 2.0 seconds after control 94 receives one or more signals from transducer 58 and/or encoder 96), control 94 may send a signal via line 102 to servomotor 88 to control the amount of rotation of threaded member 92 needed in order to apply the calculated desired braking force to be applied by brake 10. Thus, control 94 may control servomotor 88 to rotate threaded member 92 in one direction or the other a desired angle to translate arm 54, transducer 58 and sheave assembly 42A, as well as cause the pivotal movement of lever 56 and the increase or decrease of the braking force applied to rotor 36 via braking pad 38. The rotation of threaded member 92 may be controlled in any incremental amount which may equate to less than, equal to or more than a full 360 degree rotation of threaded member 92 about axis X7. Rotation of threaded member 92 may be controlled to rotate in a given direction only a certain amount before stopping, for instance, any whole number (or fraction) between 0 and 360 degrees or more, such as 1, 2, 3, 4, 5, 10, 15, 20 degrees and so forth. Thus, control 94 may (1) continuously monitor the signals from encoder 96 and transducer 58, (2) calculate the corresponding length L1, spool rate of rotation and cable tension based on these signals, and (3) control rotation of threaded member 92, for instance, to (a) not rotate threaded member 92 and thus not change the amount of braking force applied by pad 38 to rotor 36, (b) rotate threaded member 92 in one direction to either increase or decrease the amount of braking force, and (c) rotate threaded member 92 in the opposite direction to respectively decrease or increase the amount of braking force, wherein the steps (a), (b) and (c) may be performed in any order depending on the specific determination/calculations made by control 94 based on the signals from transducer 58 and encoder 96.

The computer, computer program, processor and/or logic circuit or circuits of control 94 may use the following equations to calculate the amount of tension on cable segment 24, the braking force or torque and the various other values as will be understood by the equations and subsequent notes.

$$T_2=T_1e^{\mu 2\theta}$$

$$F_2=2T_1e^{\mu\theta}\sin\theta$$

$$F=F_1+F_2$$

$$T=T_1+T_2$$

$$\tau=(L2/L3)RF_1\mu$$

For these equations, $T_2$ is the tension on cable segment 30, which may be equal to the total drag load generated by tow body 4 and the aerodynamically or hydrodynamically exposed cable length of segment 24 (i.e., the length of segment 24 exposed to air or water when towed by towing vehicles 2A and 2B respectively); $T_1$ is the tension on cable segment 28; e=Euler's number, or a constant approximately equal to 2.718 to three decimal places or 2.71828 to five decimal places; μ=the cable on post friction coefficient of segment 24 on the given friction post 42B or 42C; θ is defined earlier in the application, and may be the cable contact angle, that is, the angle of contact of the cable around one of friction posts 42B or 42C (it is noted that the angles associated with posts 42B and 42C may also be described as $\theta_1$ and $\theta_2$ or angle 1 and angle 2, where angle 1 and angle 2 describe the contact angles about 42B and 42C, such that $T_2=T_1e^{\mu 2\theta}$ becomes $T_2=T_1e^{\mu(\theta_1+\theta_2)}$); $F_2$ is the tensile load or force measured by the transducer/strain gauge 58 ($F_2=2T_1e^{\mu\theta}$ becomes $F_2=T_1e^{\mu(\theta_1)}+T_1e^{\mu(\theta_2)}$ for angles 1 and 2 noted above); T=cable tension on input segment 28 and output segment 30; F is the tensile/reactive load in shaft or arm 54 along threaded segment 72 (and may define the design of the threads of segment 72 and member 92 and the torque required from servomotor 88); $F_1$ is the force applied at pivot pin 84/axis X6 by lever 56; τ=the braking force or torque applied by brake pad 38 to rotor 36; and L2, L3 and R are as defined earlier in the present application.

System 1 may thus be a relatively lightweight system which may use substantially less electrical power for operation than those systems described in the Background section of the present application. System 1 may be able to control the spool rate of rotation and cable payout rate using only a single rotor and single brake pad 38 in contrast to the multiple rotors and stators required in the prior art system noted in the Background section. Moreover, the servomotor 88 of system 1 may require very little electrical power in order to rotate thread member 92 to effect the change in the braking force needed to control the spool rate of rotation and cable payout rate.

It is noted that various components or terms having the same names described herein may be denoted as additional or other components, or first, second, third and fourth components, etc. For instance, various pulley wheels or sheaves may be denoted as an additional pulley wheel or sheave, or another pulley wheel or sheave, or first, second, third, fourth, (etc) pulley wheels or sheaves, and so forth. Other such components or terms may include, without limitation, pivots, axes, lengths, positions and so forth.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration set out herein are an example not limited to the exact details shown or described.

The invention claimed is:

1. An apparatus comprising:

a spool;

a cable wound around the spool and including a cable segment which extends outwardly from the spool;

a brake which is operatively connected to the spool and controls a spool rate of rotation of the spool based on an amount of tension on the cable segment; and a linkage assembly which extends from the cable segment to the brake;

wherein the linkage assembly comprises a rotatable sheave which engages the cable segment, an arm on which the sheave is rotatably mounted, and a lever which is pivotally mounted at a first pivot and pivotally connected to the arm at a second pivot.

2. The apparatus of claim 1 wherein the brake controls the spool rate of rotation based on a length of the cable segment.

3. The apparatus of claim 1 wherein the brake controls the spool rate of rotation based on the spool rate of rotation.

4. The apparatus of claim 1 wherein the brake comprises a brake rotor and a brake pad which is engageable with the brake rotor.

5. The apparatus of claim 4 wherein the brake pad is mounted on and pivotally movable with the lever relative to the brake rotor.

6. The apparatus of claim 1 wherein the linkage assembly comprises a spring which extends between the lever and the brake so that the spring is compressed or decompressed in response to pivotal movement of the lever about the first pivot.

7. The apparatus of claim 6 wherein the brake comprises a brake rotor and a brake pad which is engageable with the brake rotor.

8. The apparatus of claim 1 wherein the arm has a threaded portion; and a threaded member threadedly engages the threaded portion so that rotation of the threaded member causes translation of the arm.

9. The apparatus of claim 1 wherein the lever extends from adjacent the arm toward the brake.

10. The apparatus of claim 1 wherein the linkage assembly comprises a force measurement transducer mounted on the arm.

11. The apparatus of claim 10 further comprising a control in communication with the transducer; a servomotor in communication with the control; wherein in response to a signal sent from the transducer to the control, the control sends a signal to the servomotor to cause operation of the servomotor to adjust an amount of braking force applied by the brake.

12. The apparatus of claim 1 further comprising a stationary friction post; wherein the sheave which is rotatable about an axis which is movable relative to the friction post; and wherein the cable segment engages the friction post and the sheave.

13. The apparatus of claim 1 further comprising:

a servomotor operatively connected to the sheave; and a control in communication with the servomotor, wherein the sheave is movable in response to operation of the servomotor based on a signal from the control to the servomotor.

14. The apparatus of claim 1 further comprising:

a force measurement transducer mounted on the linkage assembly;

an encoder operatively connected to the spool or the rotatable sheave which engages the cable segment; and a control in communication with the transducer and the encoder.

15. An apparatus comprising:

a spool;

a brake rotor operatively connected to the spool so that a spool rate of rotation of the spool is dependent on a brake rotor rate of rotation of the brake rotor;

a cable wound around the spool and including a cable segment which extends outwardly from the spool;

an arm;

a sheave which engages the cable segment and is rotatably mounted on the arm about a sheave axis;

a lever pivotable about a pivot axis; and a brake pad mounted on the lever and engageable with the brake rotor;

wherein the arm is operatively connected to the lever so that movement of the arm and the sheave perpendicular to the sheave axis causes pivotal movement of the lever about the pivot axis, thereby altering a braking force applied by the brake pad to the brake rotor.

* * * * *